US007750850B2

(12) United States Patent
Mei

(10) Patent No.: US 7,750,850 B2
(45) Date of Patent: Jul. 6, 2010

(54) PRINTED ANTENNA

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 365 days.

(21) Appl. No.: 11/752,314

(22) Filed: May 23, 2007

(65) Prior Publication Data

US 2008/0169982 A1 Jul. 17, 2008

(30) Foreign Application Priority Data

Jan. 12, 2007 (CN) ..... 2007 1 0200052

(51) Int. Cl.
*H01Q 1/38* (2006.01)

(52) U.S. Cl. ..... 343/700 MS; 343/846; 343/895

(58) Field of Classification Search ..... 343/700 MS, 343/702, 829, 846, 895
See application file for complete search history.

(56) References Cited

U.S. PATENT DOCUMENTS 6,069,592 A * 5/2000 Wass ..... 343/895
6,246,371 B1 * 6/2001 Kurz et al. ..... 343/702
6,388,626 B1 * 5/2002 Gamalielsson et al. ..... 343/702
6,642,893 B1 * 11/2003 Hebron et al. ..... 343/702

FOREIGN PATENT DOCUMENTS

CN 2689482 Y 3/2005

* cited by examiner

*Primary Examiner*—Tho G Phan
(74) *Attorney, Agent, or Firm*—Frank R. Niranjan

(57) ABSTRACT

A printed antenna (10) disposed on a substrate (90) includes a feeding portion (12), a first radiation portion (16), a second radiation portion (18), a matching portion (14), and a grounded portion. The feeding portion feeds electromagnetic signals. One end of the first radiation portion is electronically connected to the feeding portion, and the other end of the first radiation portion is a free end. One end of the second radiation portion is electronically connected to the feeding portion and the first radiation portion, and the other end of the second radiation portion is a free end. The second radiation portion includes a plurality of radiation segments forming at least one space, and the first radiation portion is accommodated in the space formed by the radiation segments. The matching portion is electronically connected to the feeding portion, for impedance matching. The grounded portion is located adjacent to the feeding portion.

16 Claims, 8 Drawing Sheets

PRINTED ANTENNA

BACKGROUND OF THE INVENTION

1. Field of the Invention

The present invention relates to antennas, and particularly to a printed antenna.

2. Description of Related Art

Recently, the Institute of Electrical and Electronics Engineers (IEEE) added two important protocols: IEEE 802.11a and IEEE 802.11b/g. IEEE 802.11a and 802.11b/g products work at the 5 GHz and 2.4 GHz frequencies, respectively.

Conventionally, wireless communication products employ low temperature co-fired ceramic (LTCC) antennas or planar inverted-F antennas (PIFAs) when using the two protocols simultaneously. However, though the common LTCC antennas have good performance at high frequencies and temperatures, they are expensive, and the common planar inverted-F antennas are inexpensive, but large.

SUMMARY OF THE INVENTION

An exemplary embodiment of the present invention provides a printed antenna. The printed antenna, disposed on a substrate, includes a feeding portion, a first radiation portion, a second radiation portion, a matching portion, and a grounded portion. The feeding portion feeds electromagnetic signals. The first radiation portion is bent shaped. One end of the first radiation portion is electronically connected to the feeding portion, and the other end of the first radiation portion is a free end. The second radiation portion is bent shaped. One end of the second radiation portion is electronically connected to the feeding portion and the first radiation portion, and the other end of the second radiation portion is a free end. The second radiation portion includes a plurality of radiation segments forming at least one space, and the first radiation portion is accommodated in the space formed by the plurality of radiation segments. The matching portion is electronically connected to the feeding portion, for impedance matching. The grounded portion is located adjacent to the feeding portion.

Other advantages and novel features will become more apparent from the following detailed description when taken in conjunction with the accompanying drawings, in which:

DETAILED DESCRIPTION OF THE INVENTION

Figure 1:
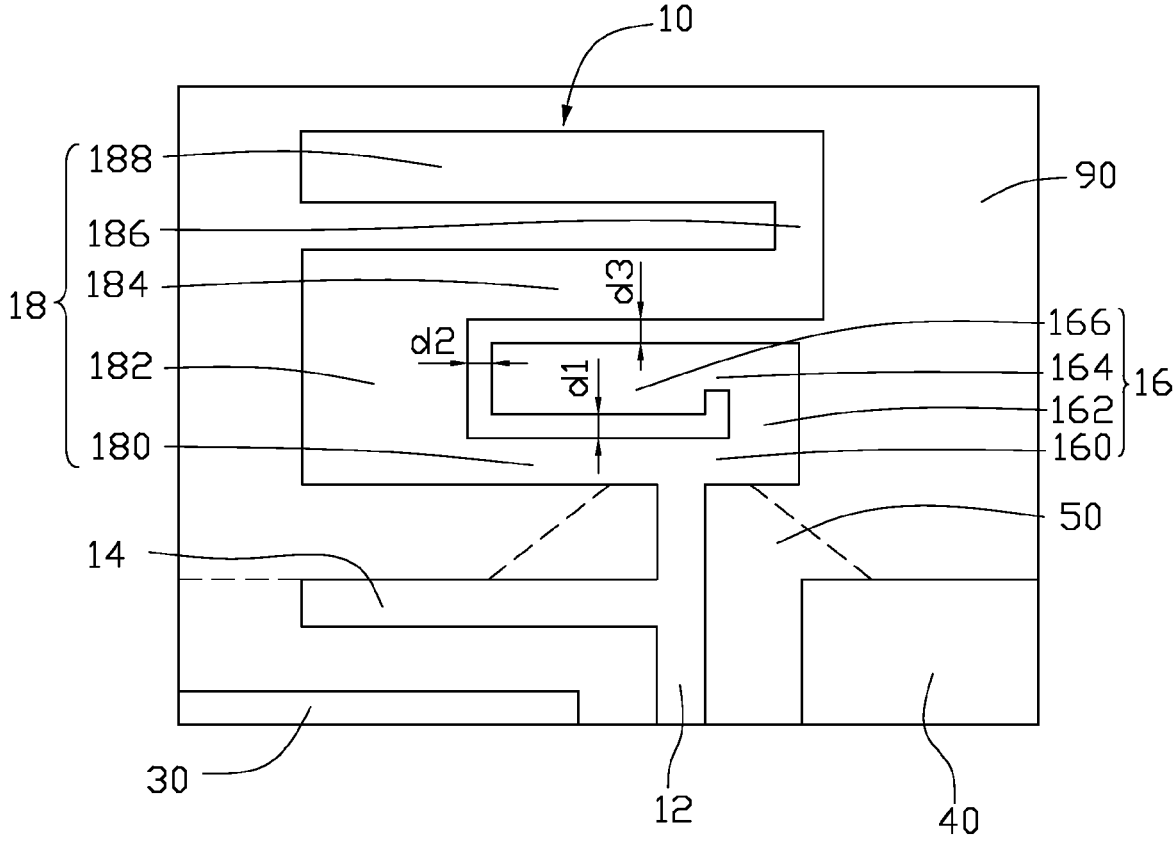
FIG. 1 is a schematic diagram of a printed antenna of an exemplary embodiment of the present invention.

FIG. 1 is a schematic diagram of an antenna assembly, especially a printed antenna 10 formed on a substrate 90 of an exemplary embodiment of the present invention. In the exemplary embodiment, the printed antenna 10, disposed on the substrate 90, includes a feeding portion 12, a matching portion 14, a radiation portion including a first radiation portion 16 and a second radiation portion 18, a grounded portion, and a grounded plane 50. The grounded portion includes a first grounded portion 30 and a second grounded portion 40. The feeding portion 12, the matching portion 14, the first radiation portion 16, the second radiation portion 18, the first grounded portion 30, and the second grounded portion 40 are all disposed on a same surface of the substrate 90, and the grounded plane 50 is disposed on another surface of the substrate 90 opposite to the surface that the first grounded portion 30 and the second grounded portion 40 are disposed on.

The feeding portion 12 is used for feeding electromagnetic signals. In the exemplary embodiment, the feeding portion 12 is a 50 ohm transmission line. The grounded portion is located adjacent to the feeding portion 12. In this embodiment, the first grounded portion 30 and the second grounded portion 40 are disposed on both sides of the feeding portion 12, respectively. The length of the first grounded portion 30 along the feeding portion 12 is less than that of the second grounded portion 40 along the feeding portion 12.

The first radiation portion 16 and the second radiation portion 18 are used for transmitting and receiving electromagnetic signals, and both are electronically connected to the feeding portion 12. The first radiation portion 16 and the second radiation portion 18 are both bent shaped. The second radiation portion 18 bounds the first radiation portion 16 on three sides. The first radiation portion 16 works at frequencies required by IEEE 802.11a, and the second radiation portion 18 works at frequencies required by IEEE 802.11b/g.

One end of the first radiation portion 16 is electronically connected to the feeding portion 12 and the second radiation portion 18, and the other end of the first radiation portion 16 is a free end. The first radiation portion 16 includes a first radiation segment 160, a second radiation segment 162, a third radiation segment 163, and a fourth radiation segment 164. The first segment 160, the second radiation segment 162, the third radiation segment 164, and the fourth radiation segment 166 are all generally rectangular shaped and electronically connected in sequence.

In the exemplary embodiment, the first radiation segment 160 is electronically connected at a right angle to the feeding portion 12. The first radiation segment 160 is perpendicular to the second radiation segment 162, and parallel to the third radiation segment 164 and the fourth radiation segment 166. The third radiation segment 164 extends from one end of the second radiation segment 162 in a same direction as the first radiation segment 160 extends from the other end of the second radiation segment 162. The third radiation segment 164 and the fourth radiation segment 166 are in a line. The fourth radiation segment 166 has a free end. A width of the third radiation segment 164 is less than that of the fourth radiation segment 166, for increasing a distance of a path of the electromagnetic signals. A first groove is definably bounded by the first, second, third and fourth radiation segments 160, 162, 164, 166 of the first radiation portion 16 and parts of the second radiation portion 18 (i.e., the fifth, sixth and seventh radiation segments 180, 182, 184 mentioned below) so as to be shaped spirally with right-angled bending. The first groove defines a clearance at a first side of the printed antenna 10.

One end of the second radiation portion 18 is electronically connected to the feeding portion 12 and the first radiation portion 16, and the other end of the second radiation portion 18 is a free end. The second radiation portion 18 is S-shaped, and includes a fifth radiation segment 180, a sixth radiation segment 182, a seventh radiation segment 184, an eighth radiation segment 186, and a ninth radiation segment 188. The fifth radiation segment 180, the sixth radiation segment 182, the seventh radiation segment 184, the eighth radiation segment 186, and the ninth radiation segment 188 are all generally rectangular shaped and electronically connected in sequence.

In other embodiments, the second radiation portion 18 may also be inverted-S-shaped.

In the exemplary embodiment, the fifth radiation portion 180 is electronically connected at a right angle to the feeding portion 12. The fifth radiation segment 180 and the first radiation segment 160 are in a line. The fifth radiation segment 180, the seventh radiation segment 184, and the ninth radiation segment 188 are parallel to each other. The sixth radiation segment 182 is parallel to the eighth radiation segment 186, and perpendicular to the fifth radiation segment 180, the seventh radiation segment 184, and the ninth radiation segment 188. The fifth radiation segment 180 extends from one end of the sixth radiation segment 182 in a same direction as the seventh radiation segment 184 extends from the other end of the sixth radiation segment 182. The seventh radiation segment 184 extends from one end of the eighth radiation segment 186 in a same direction as the ninth radiation segment 188 extends from the other end of the eighth radiation segment 186. A second groove is definably bounded by the seventh, eighth and ninth radiation segments 184, 186, 188 of the second radiation portion 18. The second groove extends straightly and defines another clearance at a second side of the printed antenna 10 opposite to the first side of the antenna 10 with the clearance of the first groove.

In the exemplary embodiment, the fifth radiation segment 180, the sixth radiation segment 182, and the seventh radiation segment 184 form one space. The seventh radiation portion 184, the eighth radiation portion 186, and the ninth radiation portion 188 form another space. The first radiation portion 16 and the first groove are accommodated in the space formed by the fifth radiation segment 180, the sixth radiation segment 182, and the seventh radiation segment 184. That is, the fifth radiation segment 180, the sixth radiation segment 182, and the seventh radiation segment 184 bounds the third radiation segment 164 and the fourth radiation segment 166 of the first radiation portion 16 through the first groove.

The matching portion 14 is electronically connected to the feeding portion 12, for impedance matching. In the exemplary embodiment, the matching portion 14 and the first grounded portion 30 are disposed on a same side of the feeding portion 12. An extending direction of the matching portion 14 is perpendicular to that of the feeding portion 12. One end of the matching portion 14 is electronically connected to the feeding portion 12, and the other end of the matching portion 14 is electronically connected to the grounded plane 50 through a via.

Figure 2:
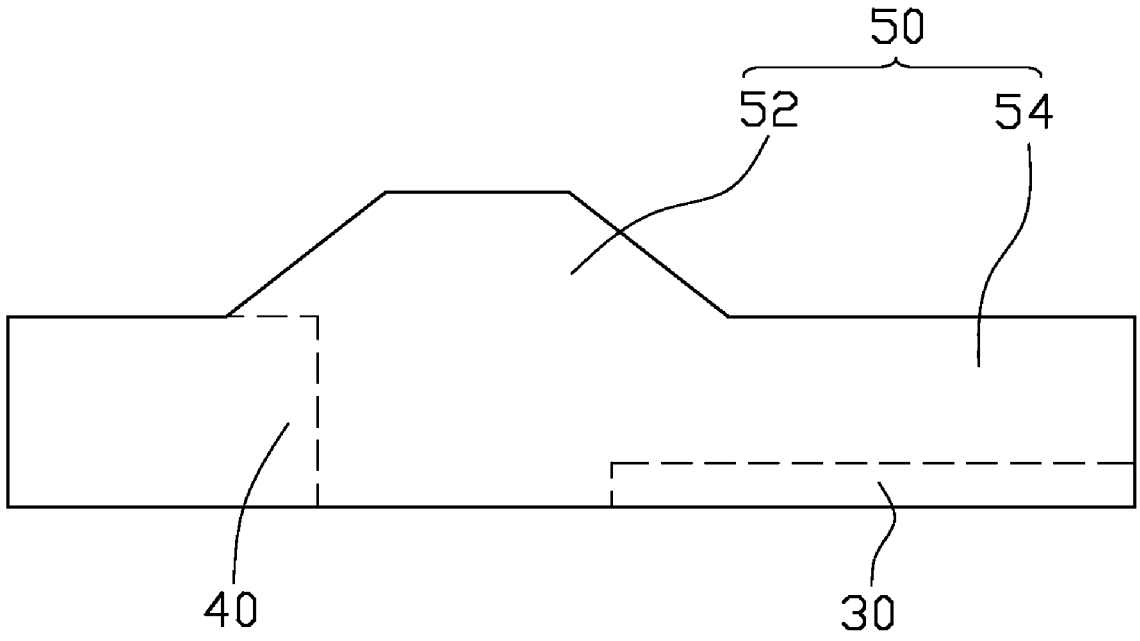
FIG. 2 is a schematic diagram of a grounded plane of FIG. 1.

FIG. 2 is a schematic diagram of the grounded plane 50 of FIG. 1. The grounded plane 50 includes a rectangular-shaped grounded body 54 and a trapezoidal-shaped protruding portion 52. The protruding portion 52 extends from the grounded body 54 to the first radiation portion 16 and the second radiation portion 18. Due to the protruding portion 52 the working bandwidth of the printed antenna 10 is increased. The projection of the first grounded portion 30 on the grounded plane 50 is inside the grounded plane 50, and the projection of the second grounded portion 40 on the grounded plane 50 is also inside the grounded plane 50.

In the exemplary embodiment, the first radiation segment 160 is substantially 2.5 mm long, and substantially 1 mm wide. The second radiation segment 162 is substantially 2 mm long, and substantially 1.5 mm wide. The third radiation segment 164 is substantially 0.5 mm long, and substantially 1 mm wide. The fourth radiation segment 166 is substantially 4.5 mm long, and substantially 1.5 mm wide. The fifth radiation segment 180 is substantially 4.5 mm long, and substantially 1 mm wide. The sixth radiation segment 182 is substantially 5 mm long, and substantially 3.5 mm wide. The seventh radiation segment 184 is substantially 7.5 mm long, and substantially 1.5 mm wide. The eighth radiation segment 186 is substantially 2.5 mm long, and substantially 1 mm wide. The ninth radiation segment 188 is substantially 10 mm long, and substantially 1.5 mm wide. The matching portion 14 is substantially 7.5 mm long, and substantially 1 mm wide.

A distance d1 of the first groove between the fourth radiation segment 166 and the fifth radiation segment 180, a distance d2 of the first groove between the fourth radiation segment 166 and the sixth radiation segment 182, a distance d3 of the first groove between the fourth radiation segment 166 and the seventh radiation segment 184 are all 0.5 mm. The first radiation portion 16 and the second radiation portion 18 produce coupling effects therebetween via the above distances d1, d2 and d3, and thereby the printed antenna 10 has a smaller size.

Figure 3:
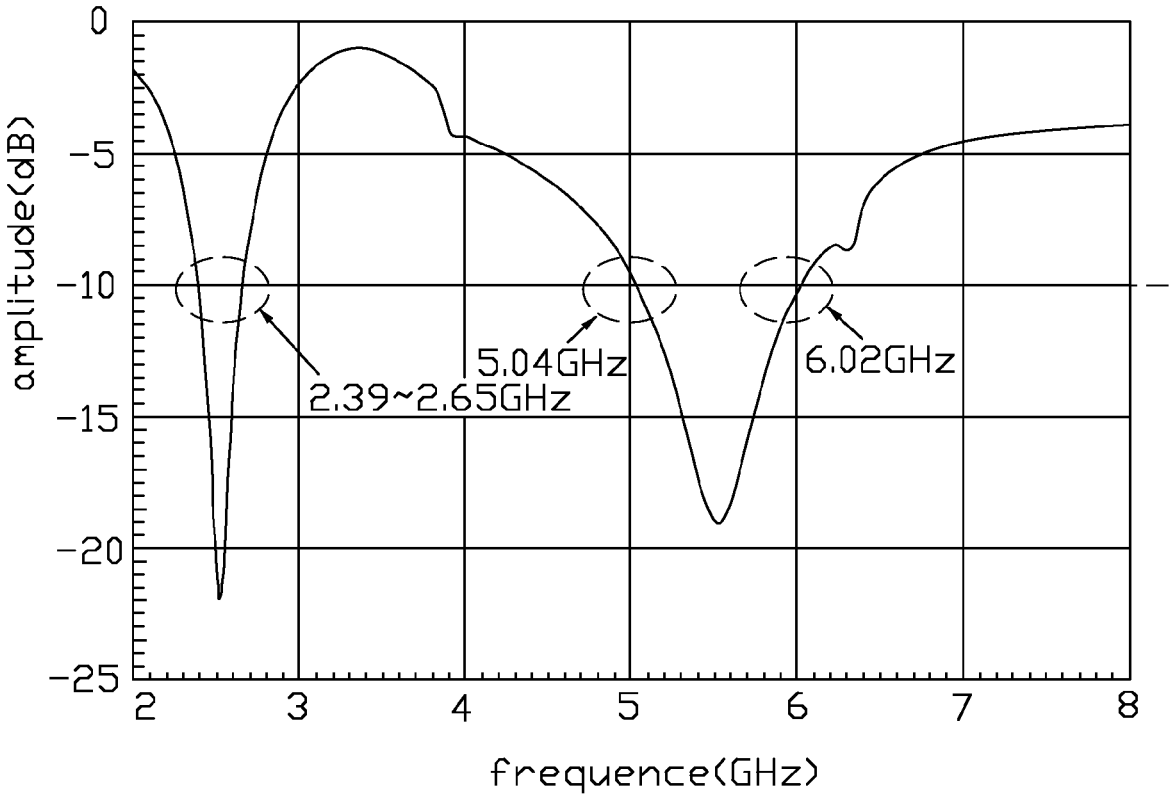
FIG. 3 is a graph of test results showing a return loss of the printed antenna of FIG. 1.
Figure 4:
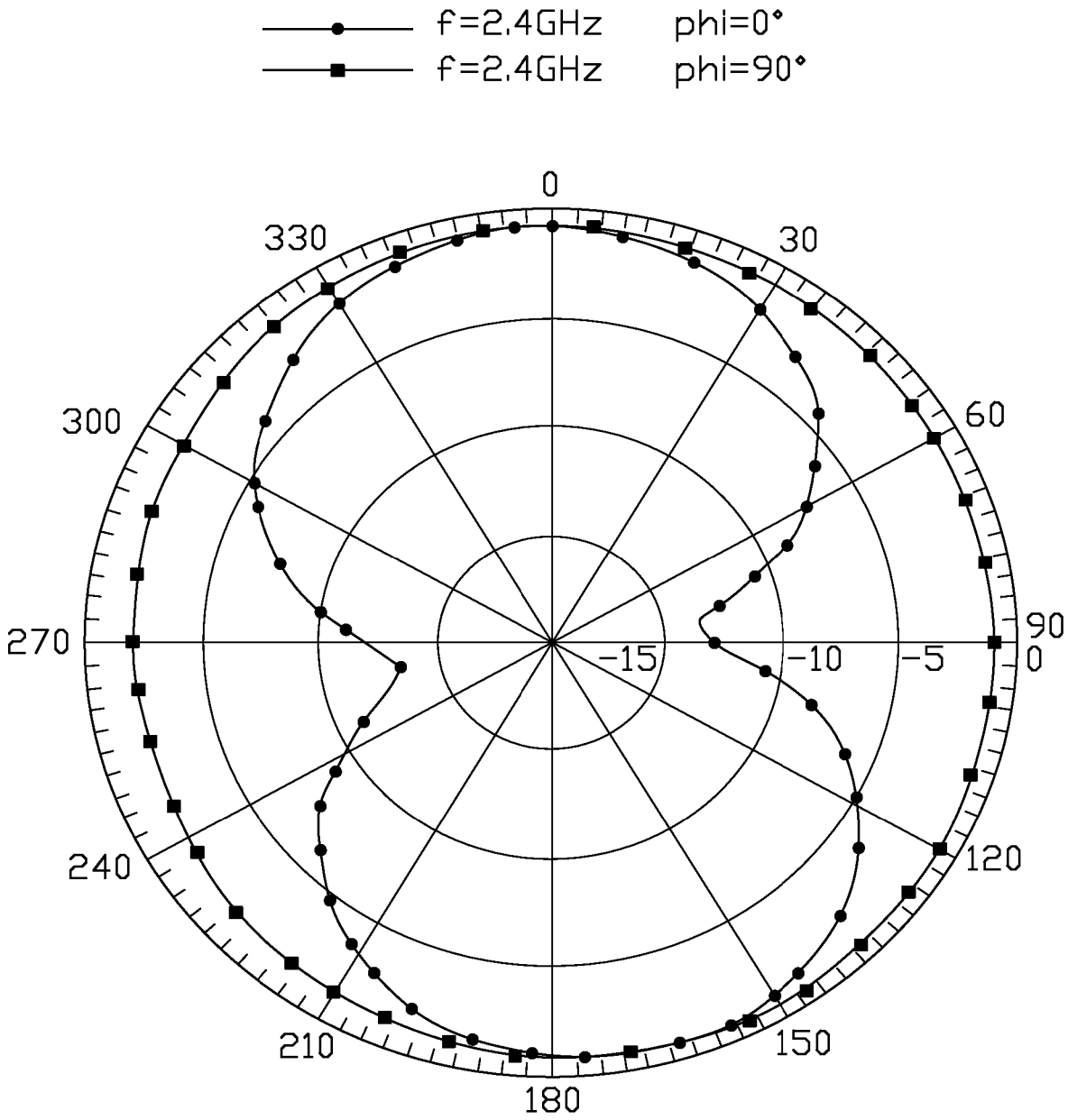
FIG. 4 is a graph of test results showing a radiation pattern when the printed antenna of FIG. 1 is operated at 2.4 GHz.
Figure 5:
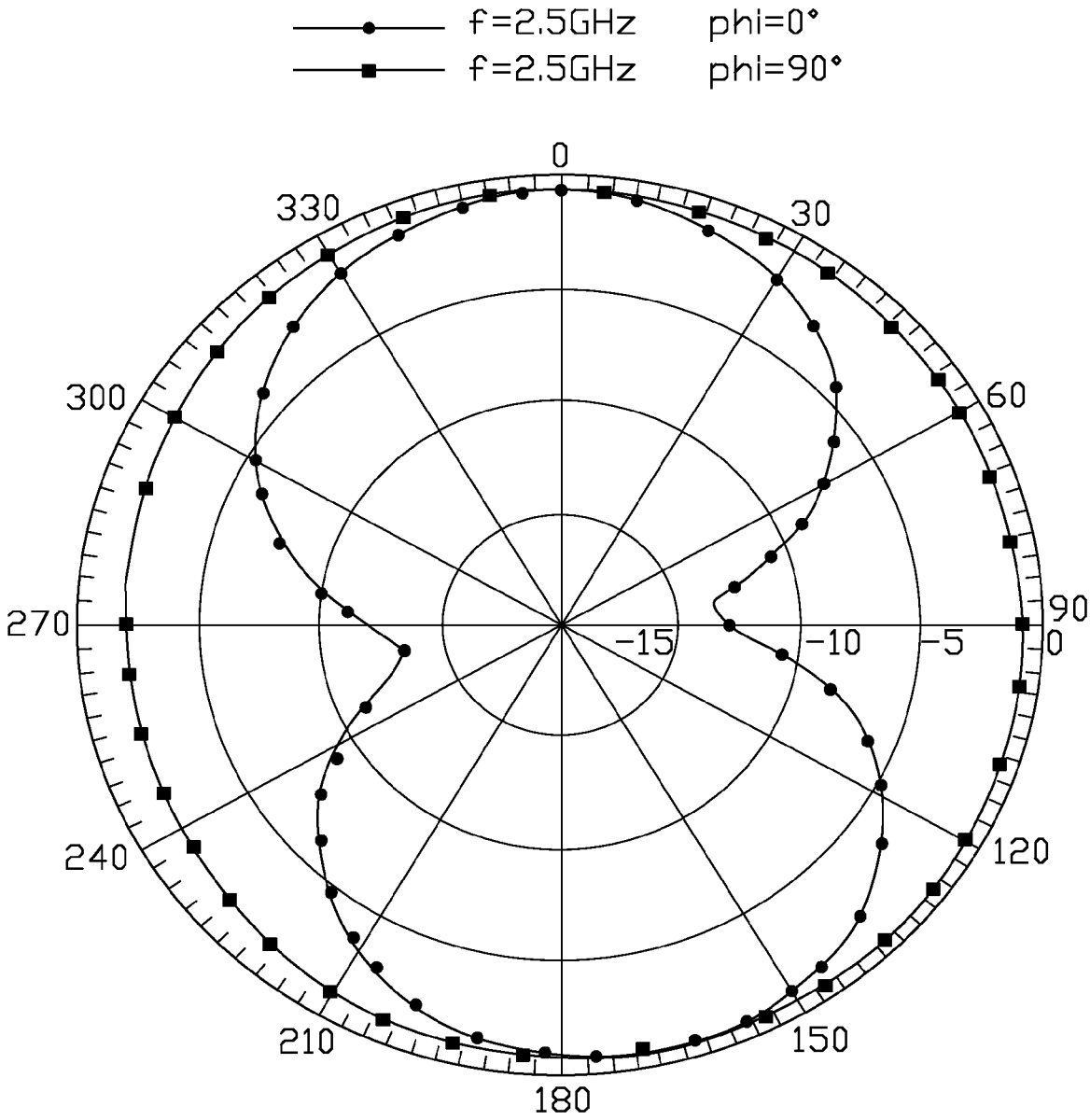
FIG. 5 is a graph of test results showing a radiation pattern when the printed antenna of FIG. 1 is operated at 2.5 GHz.
Figure 6:
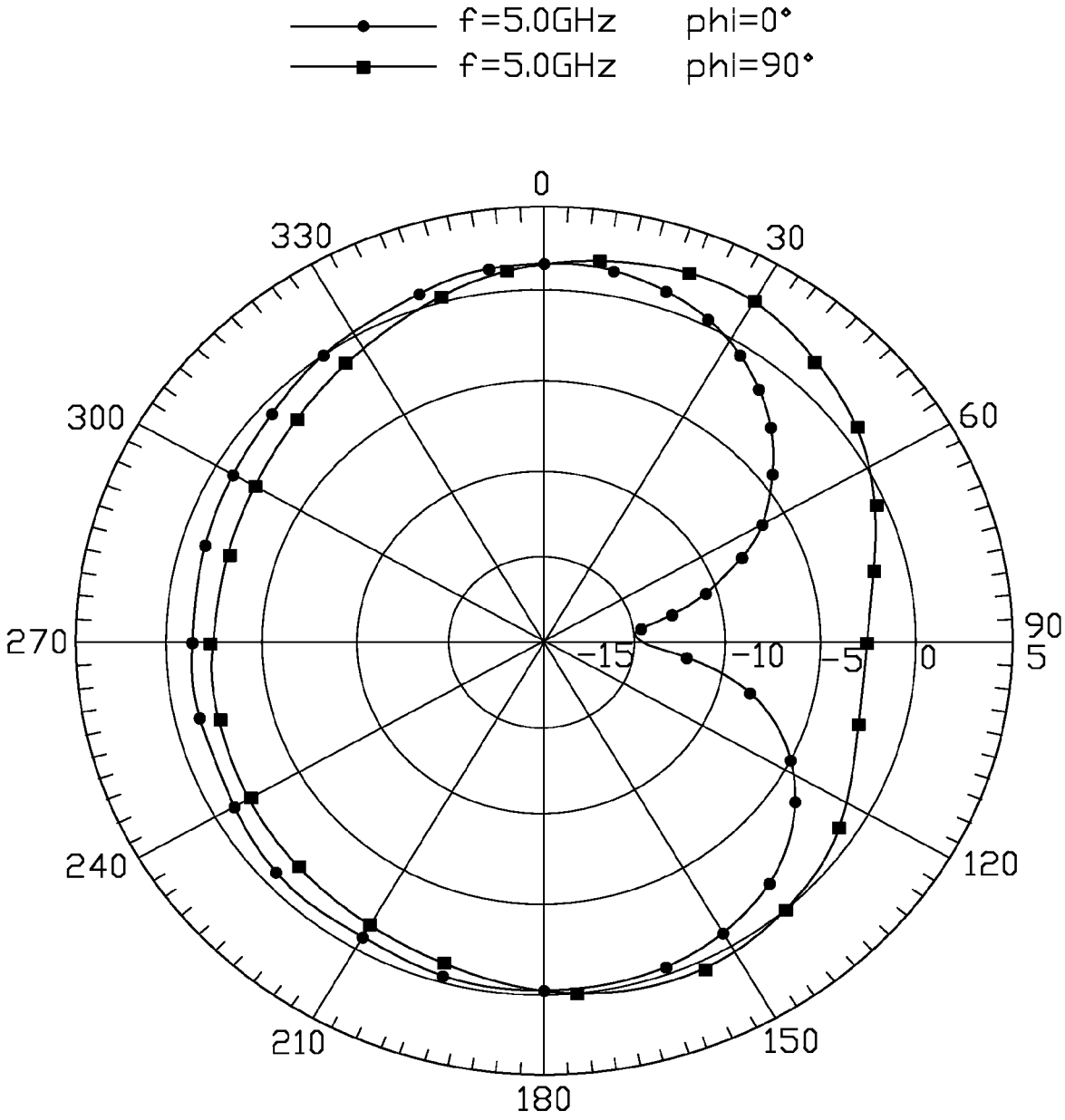
FIG. 6 is a graph of test results showing a radiation pattern when the printed antenna of FIG. 1 is operated at 5.0 GHz.
Figure 7:
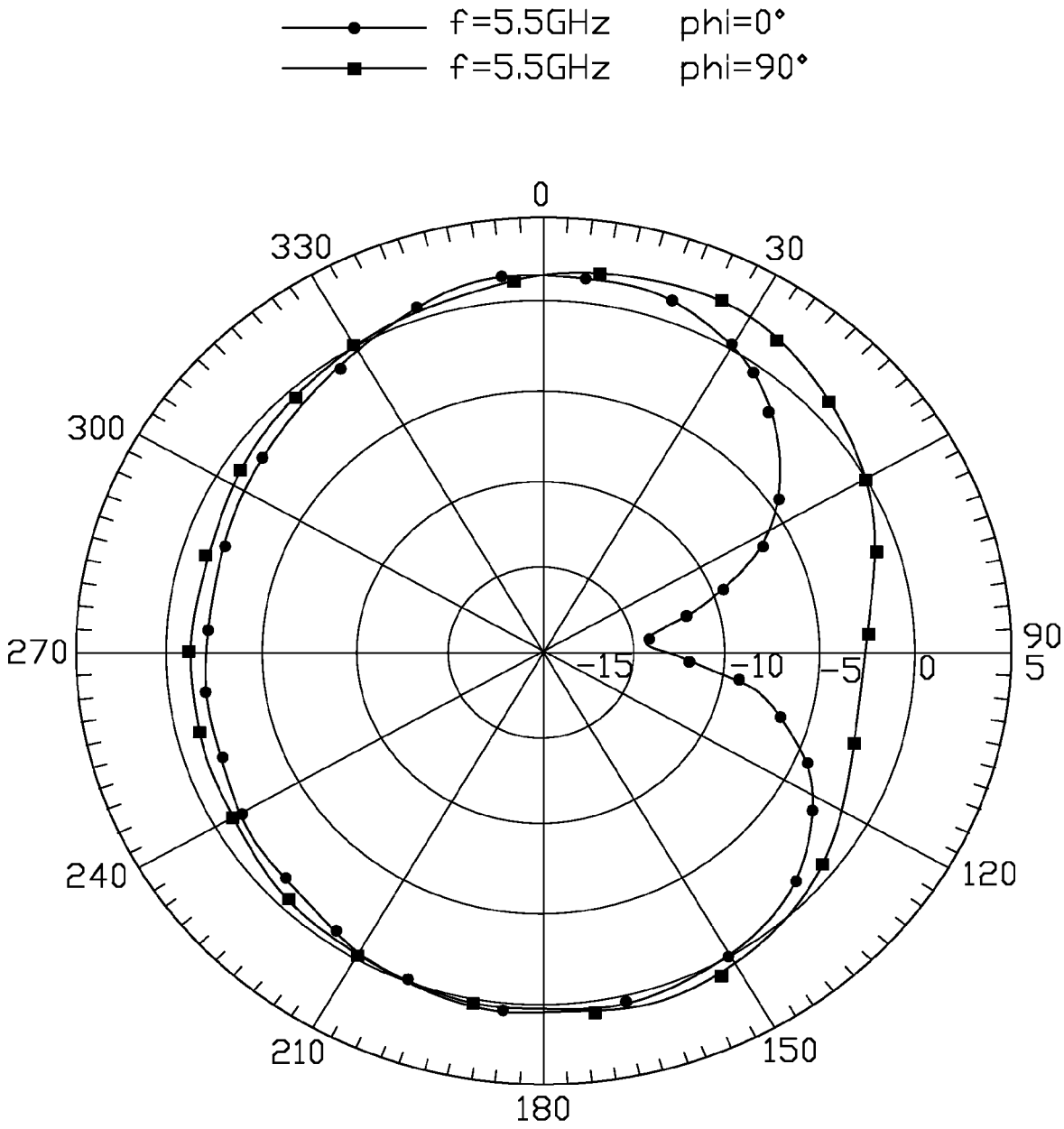
FIG. 7 is a graph of test results showing a radiation pattern when the printed antenna of FIG. 1 is operated at 5.5 GHz.
Figure 8:
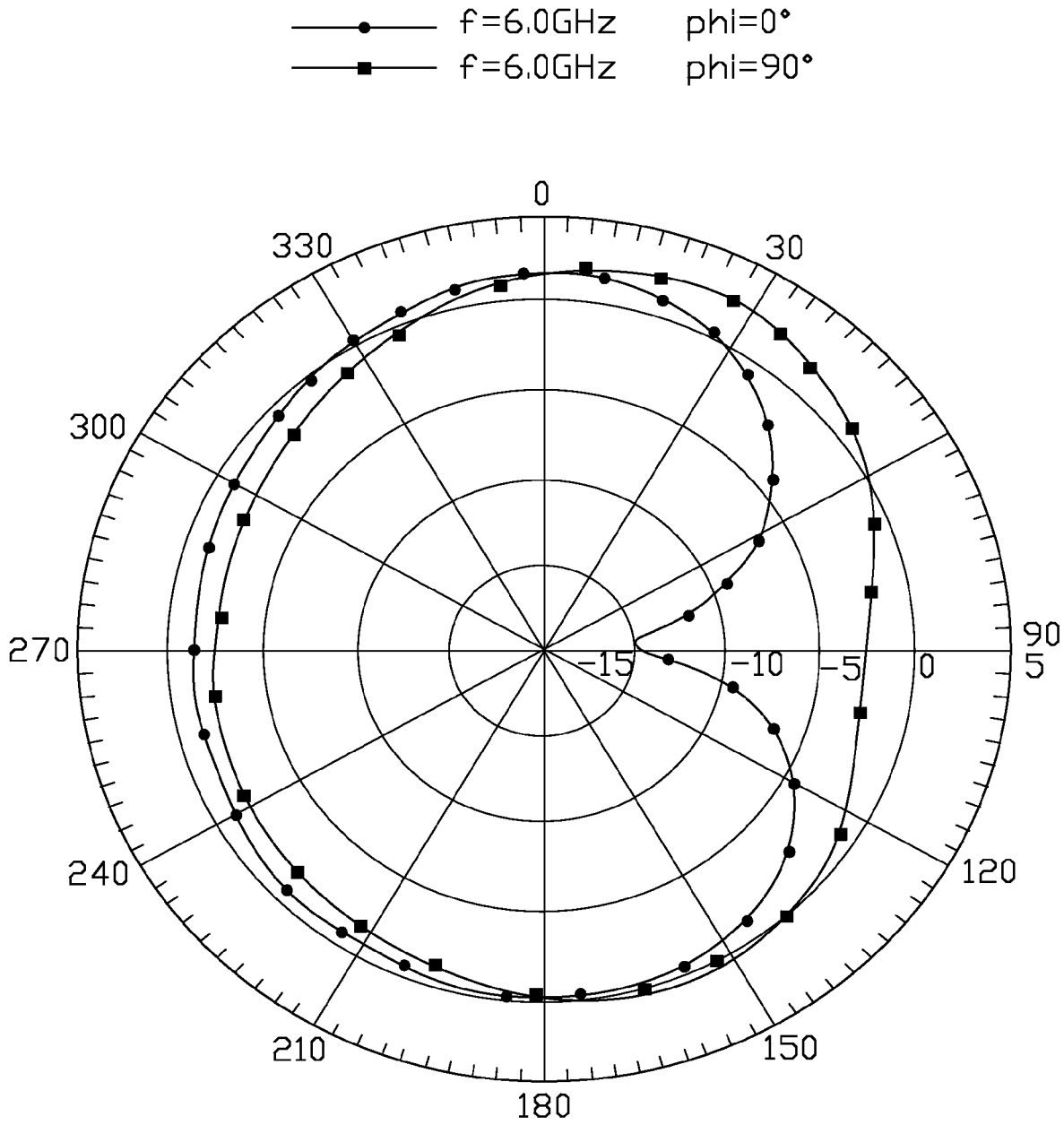
FIG. 8 is a graph of test results showing a radiation pattern when the printed antenna of FIG. 1 is operated at 6.0 GHz.

FIG. 3 is a graph of test results showing a return loss of the printed antenna 10 of FIG. 1. As shown, when the printed antenna 10 is operated at frequencies of 5-6 GHz of the IEEE 802.11a and at frequencies of 2.4-2.5 GHz of the IEEE 802.11b/g, return losses drop below −10 dB, which satisfactorily meet normal practical requirements.

FIGS. 4-8 are graphs of test results showing radiation patterns when the printed antenna 10 of FIG. 1 is operated at 2.4 GHz, 2.5 GHz, 5.0 GHz, 5.5 GHz, and 6.0 GHz, respectively. As seen, all of the radiation patterns are substantially omnidirectional.

In the exemplary embodiment of the present invention, the second radiation portion 18 bounds the first radiation portion 16. That is, the first radiation portion 16 is accommodated in one space formed by the second radiation portion 18. Therefore, the size of the printed antenna 10 is effectively reduced. In addition, due to the protruding portion 52 of the grounded plane 50, the working bandwidth of the printed antenna 10 is improved.

While various embodiments and methods of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A printed antenna, disposed on a substrate, comprising:

a feeding portion, for feeding electromagnetic signals;

a first radiation portion, being bent shaped, one end of the first radiation portion being electrically connected to the feeding portion, and the other end of the first radiation portion being a free end;

a second radiation portion, being bent shaped, one end of the second radiation portion being electrically connected to the feeding portion and the first radiation portion, and the other end of the second radiation portion being a free end, the second radiation portion comprising a plurality of radiation segments forming at least one space, and the first radiation portion being accommodated in the space formed by the plurality of radiation segments;

a matching portion, electrically connected to the feeding portion, for impedance matching; and a grounded portion, located adjacent to the feeding portion.

2. The printed antenna as claimed in claim 1, wherein the feeding portion, the first radiation portion, the second radiation portion, the matching portion, and the grounded portion are all disposed on a same surface of the substrate.

3. The printed antenna as claimed in claim 2, further comprising a grounded plane disposed on another surface of the substrate opposite to the surface that the grounded portion is disposed on.

4. The printed antenna as claimed in claim 3, wherein one end of the matching portion is electrically connected to the feeding portion, and the other end of the matching portion is electrically connected to the grounded plane through a via.

5. The printed antenna as claimed in claim 3, wherein the grounded plane comprises a grounded body and a protruding portion extending from the grounded body to the first radiation portion and the second radiation portion.

6. The printed antenna as claimed in claim 1, wherein the first radiation portion comprises a first radiation segment, a second radiation segment, a third radiation segment, and a fourth radiation segment; the first radiation segment, the second radiation segment, the third radiation segment, and the fourth radiation segment are electrically connected in sequence; the first radiation segment is perpendicular to the second radiation segment, and is parallel to the third radiation segment and the fourth radiation segment; the third radiation segment and the fourth radiation segment are in a line.

7. The printed antenna as claimed in claim 6, wherein the width of the third radiation segment is less than the width of the fourth radiation segment, for increasing a distance of a path of the electromagnetic signals.

8. The printed antenna as claimed in claim 6, wherein the second radiation portion comprises a fifth radiation segment, a sixth radiation segment, a seventh radiation segment, an eighth radiation segment, and a ninth radiation segment, and the fifth radiation segment, the sixth radiation segment, the seventh radiation segment, the eighth radiation segment, and the ninth radiation segment are connected in sequence; the fifth radiation segment, the seventh radiation segment, and the ninth radiation segment are parallel to each other; the sixth radiation segment is parallel to the eighth radiation; the sixth radiation segment and the eighth radiation segment are perpendicular to the fifth radiation segment, the seventh radiation segment, and the ninth radiation segment.

9. The printed antenna as claimed in claim 8, wherein the fifth radiation segment, the sixth radiation segment, and the seventh radiation segment form one space, and the third radiation segment and the fourth radiation segment are accommodated in the formed space.

10. The printed antenna as claimed in claim 9, wherein the first radiation portion and the second radiation portion produce coupling effects therebetween via a distance between the fourth radiation segment and the fifth radiation segment, a distance between the fourth radiation segment and the sixth radiation segment, and a distance between the fourth radiation segment and the seventh radiation segment.

11. The printed antenna as claimed in claim 9, wherein the seventh radiation segment, the eighth radiation segment, and the ninth radiation segment form another space.

12. The printed antenna as claimed in claim 1, wherein the second radiation portion has a selective one of an S-shaped configuration and an inverted-S-shaped configuration.

13. The printed antenna as claimed in claim 1, wherein the grounded portion comprises a first grounded portion and a second grounded portion; the first grounded portion and the second grounded portion are respectively disposed on both sides of the feeding portion.

14. The printed antenna as claimed in claim 13, wherein a length of the first grounded portion along the feeding portion is less than that of the second grounded portion along the feeding portion.

15. The printed antenna as claimed in claim 14, wherein the first grounded portion and the matching portion are disposed on the same side of the feeding portion.

16. The printed antenna as claimed in claim 1, wherein an extending direction of the matching portion is perpendicular to that of the feeding portion.

* * * * *